US007124542B2

(12) United States Patent
Hofmann

(10) Patent No.: US 7,124,542 B2
(45) Date of Patent: Oct. 24, 2006

(54) BUILDING HAVING A PITCHED, SCULPTURED TILE ROOF WITH A RIDGE EXTENDING ATOP THE PITCHED, SCULPTURED TILE ROOF, WHICH PITCHED, SCULPTURED TILE ROOF HAS A PITCHED TILE ROOF VENTING ARRANGEMENT

(75) Inventor: Karl-Heinz Hofmann, Mücke (DE)

(73) Assignee: Lafarge Roofing Components GmbH & Co. KG, Oberursel (DE)

( * ) Notice: Subject to any disclaimer, the term of this patent is extended or adjusted under 35 U.S.C. 154(b) by 433 days.

(21) Appl. No.: 10/214,470

(22) Filed: Aug. 7, 2002

(65) Prior Publication Data

US 2003/0041530 A1 Mar. 6, 2003

(30) Foreign Application Priority Data

Aug. 9, 2001 (DE) ..... 101 39 273

(51) Int. Cl.
*E04B 7/00* (2006.01)
*E04H 12/28* (2006.01)

(52) U.S. Cl. ..... 52/198; 52/302.1; 52/302.3; 52/408; 52/57

(58) Field of Classification Search ..... 52/198, 52/90.1, 302.1, 302.3, 408, 409, 518, 57, 52/199; 454/365, 366
See application file for complete search history.

(56) References Cited

U.S. PATENT DOCUMENTS 5,002,816 A * 3/1991 Hofmann et al. ..... 428/138
5,738,581 A * 4/1998 Rickert et al. ..... 454/365
5,947,817 A * 9/1999 Morris et al. ..... 454/365
6,128,870 A * 10/2000 Kohler ..... 52/199
6,286,273 B1 * 9/2001 Villela et al. ..... 52/199
6,537,147 B1 * 3/2003 Smith ..... 454/365
6,558,251 B1 * 5/2003 Sells ..... 454/359

FOREIGN PATENT DOCUMENTS

| | | |
|---|---|---|
| DE | 2256675 | 5/1974 |
| DE | 2649790 | 5/1978 |
| DE | 9319360 | 3/1994 |
| DE | 19523834 | 1/1997 |
| DE | 19954417 | 6/2001 |
| EP | 0117391 | 4/1987 |
| EP | 0341343 | 1/1992 |
| EP | 0610324 | 12/1997 |
| EP | 0974712 | 1/2000 |
| EP | 1013845 | 6/2000 |
| GB | 2155516 | 9/1985 |

* cited by examiner

*Primary Examiner*—Carl D. Friedman
*Assistant Examiner*—Chi Q. Nguyen
(74) *Attorney, Agent, or Firm*—Nils H. Ljungman & Associates

(57) ABSTRACT

There is now provided a building having a pitched, sculptured tile roof with a ridge extending atop the pitched, sculptured tile roof, with a pitched tile roof venting arrangement disposed at the ridge. The building has walls to support a roof having a ridge beam, roof rafters, and battens that support roofing tiles. The roof also has a row of ridge tiles disposed on said ridge beam. A venting arrangement is disposed atop the ridge beam, between the ridge tiles and the roofing tiles. The venting arrangement has a center strip that is placed onto the ridge beam, and two side strips that cover a portion of adjacent uppermost roofing tiles. The side strips have air venting openings for the passage of air from beneath the roof to the outside of the roof. The air venting openings are covered by cover bands which cover bands permit passage of air to flow therethrough and prevent rain or drift snow to readily penetrate through the air venting openings.

20 Claims, 9 Drawing Sheets

BUILDING HAVING A PITCHED, SCULPTURED TILE ROOF WITH A RIDGE EXTENDING ATOP THE PITCHED, SCULPTURED TILE ROOF, WHICH PITCHED, SCULPTURED TILE ROOF HAS A PITCHED TILE ROOF VENTING ARRANGEMENT

BACKGROUND OF THE INVENTION

1. Field of the Invention

The invention relates to a building having a pitched, sculptured tile roof with a ridge extending atop the pitched, sculptured tile roof, which pitched, sculptured tile roof has a pitched tile roof venting arrangement.

2. Background Information

Building roofs comprise frame structures supported on the walls of a building. Conventional roof construction generally proceeds from a point at which all of the walls of the structure are erected and the structural members for the ceiling called "ceiling joists" are in place. Ceiling joists will typically be members placed center to center and spanning the narrow width of the structure. Splices in joists are preferably arranged to coincide with internal load bearing walls. Rafters are also placed center to center so that this spacing of joists permits fastening the ends of the rafters adjacent to a corresponding joist in every case. Conventional roof construction also has a ridge member and the top end of the rafter needs to be angle cut with the aid of the rafter square for a proper fit against the ridge member and possibly allowance for half the thickness of the ridge member must be made in determining the distance from the top of the rafter. Often the rafter is left with a "tail" which provides an overhang for the roof. The rafter tail may be "plumb cut" at an angle also using the rafter square. To mount roofing tiles on the roof, longitudinal straps or battens are disposed on the rafters substantially parallel to the ridge of the roof. The roofing tiles are then disposed in rows on the battens and ridge tiles are disposed on the ridge of the roof.

There arises the need at roofs for ridge coverings and ridge ventilations that serve for sealing the gaps remaining between ridge battens and roofing tiles and simultaneously for ensuring the adequate ventilation of the roof framing. Such gaps extend on both sides of the ridge battens in the longitudinal direction of the roof ridge. There also arises the need that the ridge coverings and ridge ventilations prevent rain water, snow, insects or debris from penetrating into the interior of the roof. There also arises the need that the roof interior is simultaneously ventilated in order to protect the roof framing against damage due to rot.

U.S. Pat. No. 5,377,459 issued to Freiborg on Jan. 3, 1995 discloses a ridge cover also useable as a shingle having a three dimensional appearance, together with methods of making and using the same. In one embodiment, right isosceles triangular pieces of asphalt composition roofing material are cut. Thereafter, the material on each side of the center line bisecting the right angle is folded under the top surface of the asphalt composition material a plurality of times in a Z-fold manner along lines approximately parallel to the center line to effectively progressively thicken the material at the respective side of the center line, the folding pattern for the two sides being symmetrical with each other. In manufacture, the triangle shaped pieces may be cut from a roll of material with no waste, may be progressively folded, stacked for shipment in a substantially solid stack, easily bent over a ridge during installation, and nailed into position utilizing hidden nails to obtain double coverage on hip and ridges in a manner simulating the outline of a heavy wood shape hip and ridge cover. The symmetry of the cover makes the same also useful as a shingle for a pronounced three dimensional hidden nail double coverage installation.

U.S. Pat. No. 5,426,898 issued to Larsen on Jun. 27, 1995 discloses a lead-free plate-shaped roof flashing material that comprises a sandwich structure in which a stress damping and stabilizing layer of ductile material is completely covered on one side and at least partly covered on the other side by preferably metallic foil sheetings, e.g. of aluminum foil, designed with densely positioned flattened folded sections having such a form, e.g. closed inverted pleats, that a material layer of each folded section gets into contact with the stress damping and stabilizing layer only when the folded sections open in connection with deforming the flashing material to make it fit to the roofing.

U.S. Pat. No. 5,440,855 issued to Loucks on Aug. 15, 1995 discloses roofing components and method for pitched roofs includes a flexible base and one or more ranks of integrally formed thin blades, vanes or fins extending outwardly from the base. The blades, fins or vanes are spaced substantially parallel to each other and overlap to shadow lower elements and to provide air circulation and between blades, which are designed to sluff-off heat and impede thermal energy being transmitted to the roof. The blades, fins or vanes are flexible and resilient so as to absorb the impact of falling material (limbs, etc.). One edge portion of the base is free of blades to provide an overlapped area for installation on a pitched roof. Various overlapping and interlocking arrangements are disclosed for sealing purposes.

Ridge coverings and ridge ventilations serve for sealing the gaps remaining between ridge batten and roofing and simultaneously for ensuring the aeration and ventilation of the roof framing. These gaps extend on both sides of the ridge batten in the longitudinal direction of the roof ridge. The ridge coverings and ridge ventilations prevent rain water, snow, insects or debris from penetrating into the interior of the roof. The roof interior is simultaneously ventilated in order to protect the roof framing against damage due to rot.

A sealing strip for a ridge or peak covering with an air-permeable center strip and side strips bordering thereon is already known (EP O 341 343 Bl, corresponding to U.S. Pat. No. 5,002,816 issued to Hofmann et al. on Mar. 26, 1991). The center strip herein is comprised of an air-permeable, water-repellent and drift-snow-proof nonwoven fabric, while the side strips are comprised of soft polyisobutylene.

A similar ridge sealing strip with a center region and two side regions adjoining thereon is disclosed in WO 99/09272. The center region is herein comprised of a material which while it is air- or vapor-permeable, also has rain and snow-proof properties. The side regions, in contrast, are impermeable to moisture.

A ridge or peak ventilation element with a center part fastenable on a ridge or peak batten, as well as with side parts adjoining the center part on both sides, which can be placed with their outer margin regions onto roof coverings, is also known from EP 1013 845 A1. The outer margin regions are therein comprised of an air-permeable woven fabric and metal foil strips adjoining them.

Furthermore known is a ridge covering whose central zone is comprised of a nonwoven fabric, which ensures the penetration of air (EP O 610 324 B1). The central zone is laterally adjoined by two needled margin regions. To attain waterproofness with simultaneous air-permeability the ridge sealing is impregnated with acrylic resin. In the region of overlap of the central zone with the margin regions, air penetration channels are provided in the lateral direction.

In the case of the above listed known ridge sealings the venting takes essentially place through a nonwoven fabric. The advantage of these sealings comprises that they form a very good protection against drifting snow. However, disadvantageous is the fact that the nonwoven fabric directly forms the venting planes. Hereby the venting cross section is reduced to only 20 to 30% of the cross section proper. In addition, after loading with driven water, thorough soaking and water penetration can occur. On the relatively flatly positioned venting nonwoven fabrics, moreover, dust, insects or leaf residues can become deposited, which at least temporarily can lead to severe decrease of the venting.

Ridge and peak ventilation elements are also known, however, in whose central and/or lateral strip air penetration openings are provided (EP 0 974 712 A2; EP O 117 391 B1, corresponding to U.S. Pat. No. 4,573,291 issued to Hofmann on Mar. 4, 1986). About the air penetration openings can be provided up-right edges to prevent rain water from flowing in, which may penetrate into the uncovered junctions between the overlapping ends of the cover cap (cf. EP O 117 391 B1, corresponding to U.S. Pat. No. 4,573,291 Issued to Hofmann on Mar. 4, 1986).

The advantage of the ventilation elements with air penetration openings comprises that they have good venting effects. Therefore, water can normally not penetrate into the roof framing since the ventilation elements are covered by the ridge tiles. However, under extreme weather conditions, when rain water or snow are driven up by wind, secure tightness is not given.

Also known is a sealing strip for a ridge or peak covering, which comprises two sealing flaps connected each at their one end, which are provided with venting openings, through which air can penetrate into the interior of the roof (DE 22 56 675 A1, corresponding to GB Patent No. 1,449,506 filed on Nov. 16, 1973). In order to separate especially positively entrained rain water, drift snow or dust, the venting openings are disposed such that they are offset with respect to one another. In the case of this sealing strip, venting is difficult if the sealing flaps are disposed one on the other, since, due to the offset of the venting openings, the air is cut off. On the other hand, penetration, in particular of dust, is facilitated if the sealing flaps are not disposed tightly one on the other.

In the case of another known sealing strip for a ridge or peak covering, two side strips comprising venting openings are connected with one another by a center strip (DE 26 49 790 A1, corresponding to GB Patent No. 1,579,550 filed on Oct. 28, 1977). However, through these venting openings rain, snow and dust can readily penetrate.

Furthermore is known a ridge sealing strip, which comprises a central region making possible the removal of moisture of the subjacent ridge space, which is adjoined by lateral water-repellent side regions (WO 99/09272 A1). The central region is continuously width-variable at least in the boundary region on each side region. The known ridge sealing strips, however, do no have any venting openings.

While such venting openings are provided in another known ridge sealing strip (GB 2 155 516 A1, corresponding to U.S. Pat. No. 4,558,637 issued to Mason on Dec. 17, 1985), these venting openings are, however, not separately protected.

OBJECT OF THE INVENTION

The embodiments of the invention therefore address the problem of providing a device for the covering and ventilation of a ridge or peak region of a roof, which ensures good venting of the roof framing.

The objects of the present invention also include creating a building having a pitched, sculptured tile roof with a ridge extending atop the pitched, sculptured tile roof, which pitched, sculptured tile roof has a pitched tile roof venting arrangement.

SUMMARY OF THE INVENTION

The invention teaches that these objects can be accomplished by a building having a pitched, sculptured tile roof with a ridge extending atop said pitched, sculptured tile roof; said building comprising walls; said pitched, sculptured tile roof being supported by said walls; said pitched, sculptured tile roof comprising: a ridge beam disposed at said ridge of said pitched, sculptured tile roof; said ridge beam having a predetermined length to provide a length dimension of said pitched, sculptured tile roof; said ridge beam having a first end and a second end remote from said first end; a plurality of roof rafter pairs, each comprising a first roof rafter and a second roof rafter; each said first roof rafter being disposed between a corresponding wall and said ridge beam at a predetermined angle of inclination at a first pitched side of said pitched, sculptured tile roof; each said second roof rafter being disposed between a corresponding wall and said ridge beam at a predetermined angle of inclination at a second pitched side of said pitched, sculptured tile roof; a plurality of roof battens comprising a first, uppermost, roof batten disposed on said first side of said pitched, sculptured tile roof, and also comprising a second, uppermost, roof batten disposed on said second side of said pitched, sculptured tile roof; each roof batten having a length dimension, each roof batten length dimension being disposed substantially parallel to the direction of said length dimension of said ridge beam; a plurality of sculptured roofing tiles which form a three dimensional structured surface disposed on said pitched, sculptured tile roof; said plurality of sculptured roofing tiles comprising a first, uppermost, row of roofing tiles disposed substantially adjacent said ridge beam on said first, uppermost, roof batten on said first pitched side of said pitched, sculptured roof; and said plurality of roofing tiles comprising a second, uppermost, row of roofing tiles disposed substantially adjacent said ridge beam on said second, uppermost, roof batten at said second pitched side of said pitched, structured tile roof; a plurality of ridge tiles disposed in a row atop said ridge beam between said first and second ends of said ridge beam; and a venting arrangement configured and dimensioned to vent air from beneath said roof to the outside of said roof, and also configured to substantially minimize passage of water from the outside of said roof to beneath said roof; said venting arrangement comprising: a central band portion being disposed between said row of ridge tiles and said ridge beam; said central band portion comprising a first edge portion extending beyond said ridge beam and being disposed towards said first side of said pitched, sculptured tile roof; and said central band portion comprising a second edge portion disposed opposite said first edge portion; said second edge portion extending beyond said ridge beam and being disposed towards said second side of said roof; a first side strip, connected to said first edge portion of said central band portion and being dimensioned and disposed to cover at least a portion of said first, uppermost, row of sculptured roofing tiles; said first side strip comprising a plurality of first venting openings configured and dimensioned to provide a venting path for air from beneath said first side of said pitched, sculptured tile roof to the outside of said pitched, sculptured tile roof; a second side strip connected to said second edge portion of said central band portion and being dimensioned and disposed to cover at least a portion of said second, uppermost, row of sculptured roofing tiles; said second side strip comprising a plurality of second venting openings configured and dimensioned to provide a venting path for air from beneath said second side of said pitched, sculptured tile roof to the outside of said pitched, sculptured tile roof; a first band, comprising a material being configured and dimensioned to permit passage of air through said first venting openings and through said first band, and said material being configured and dimensioned to substantially minimize passage of water through said first band and said first venting openings, said first band being connected to said central band portion and also to said first side strip, and being disposed substantially adjacent said first venting openings; and a second band, comprising a material being configured and dimensioned to permit passage of air through said second venting openings and through said second band, and said material being configured and dimensioned to substantially minimize passage of water through said second band and through said second venting openings, said second band being connected to said central band portion and also to said second side strip, and being disposed substantially adjacent said second venting openings.

The invention also teaches in one aspect that these objects can be accomplished thereby that between a central cover band and a first side strip is provided a first air-permeable, but water-impermeable, band, which covers over venting openings of the first side strip, and that between the central cover band and a second side strip is provided a second air-permeable, but water-impermeable, band, which covers over venting openings of the second side strip.

In one aspect, the invention consequently relates to a device for the covering and ventilation of a ridge or peak region of a roof. This device comprises a center strip and two side strips, with the center strip, which can be placed onto a ridge batten, being covered by an additional cover band. This additional cover band is only connected with the center strip such that the pliant side strips can be folded downwardly and be formed onto the top side of roofing tiles. At both sides of the ridge batten are located venting openings, which are shielded by the cover band at a clearance. So that through the venting openings no rain or drift snow penetrates into the ridge, on the longitudinal margins of the cover band and underneath the venting openings an air-permeable nonwoven shielding fabric is fastened on the side strips. As long as the ridge element is rolled up, the nonwoven shielding fabric is disposed with superjacent folds between the cover band and the side strips. However, after unrolling on the ridge batten and after the side strips are unwound, the nonwoven shielding fabric unfolds in the manner of an accordion.

The advantage attained with the embodiments of the invention consequently comprises that the venting holes are completely covered at the top with a waterproof cover band and indirectly secured against the sides with a nonwoven fabric of high air permeability. Hereby waterproofness and good aeration of the roof framing is ensured. In other words good venting of the roof and the roof framing is ensured.

The above-discussed embodiments of the present invention will be described further hereinbelow. When the word "invention" is used in this specification, the word "invention" includes "inventions", that is the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the embodiments which are illustrated in the accompanying drawings.

DESCRIPTION OF THE PREFERRED EMBODIMENT

Figure 1:
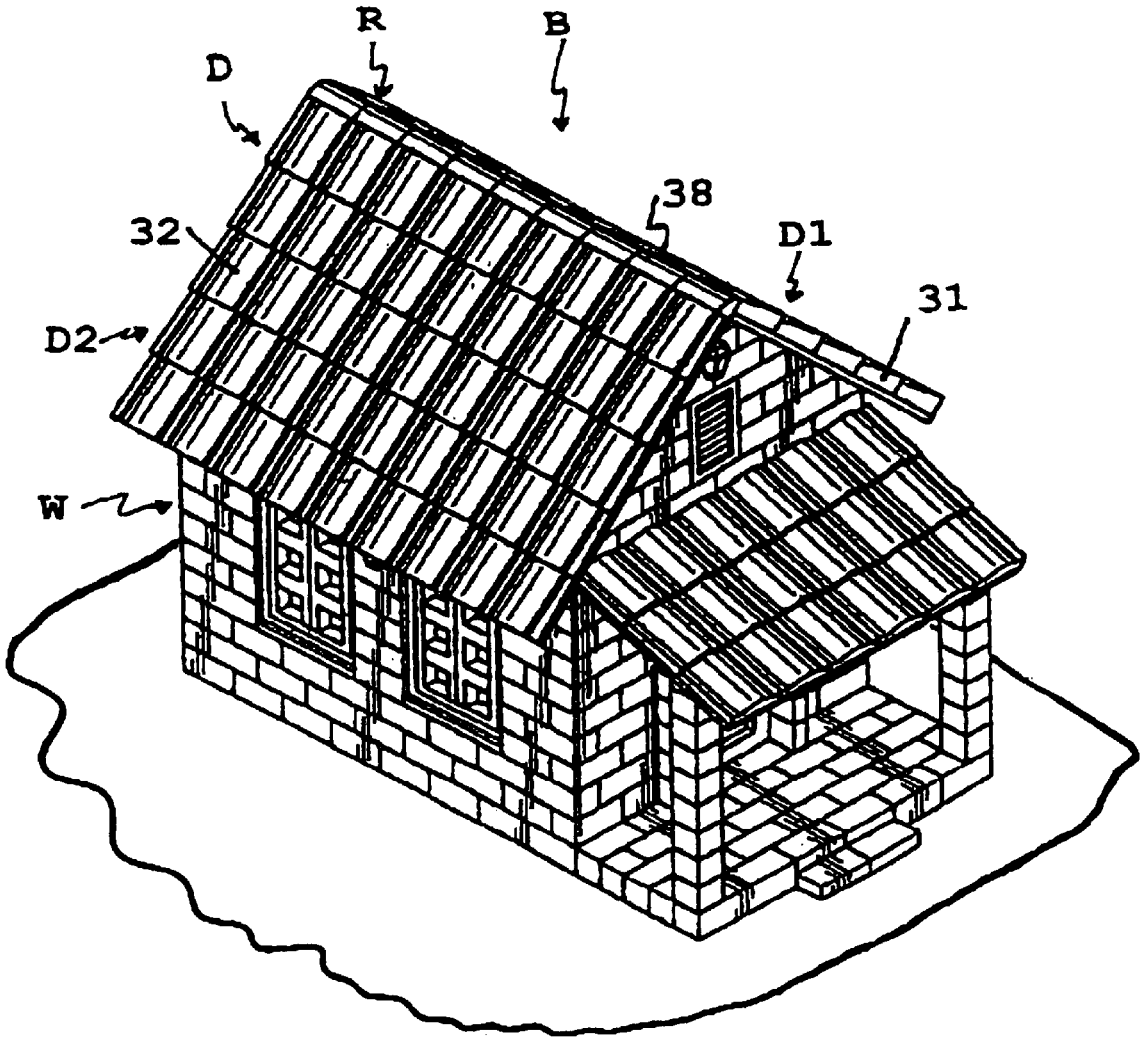
FIG. 1 is a perspective view of a building in accordance with one embodiment of the invention.

With reference to FIG. 1, a building B has a pitched, sculptured tile roof D with a ridge R extending atop the pitched, sculptured tile roof D. For general illustration, the roof D comprises a first side D1 and a second side D2. The roof is supported on walls W as is known in the art. The roof has roofing tiles such as 31 and 32 and a row of ridge tiles 38.

Figure 2:
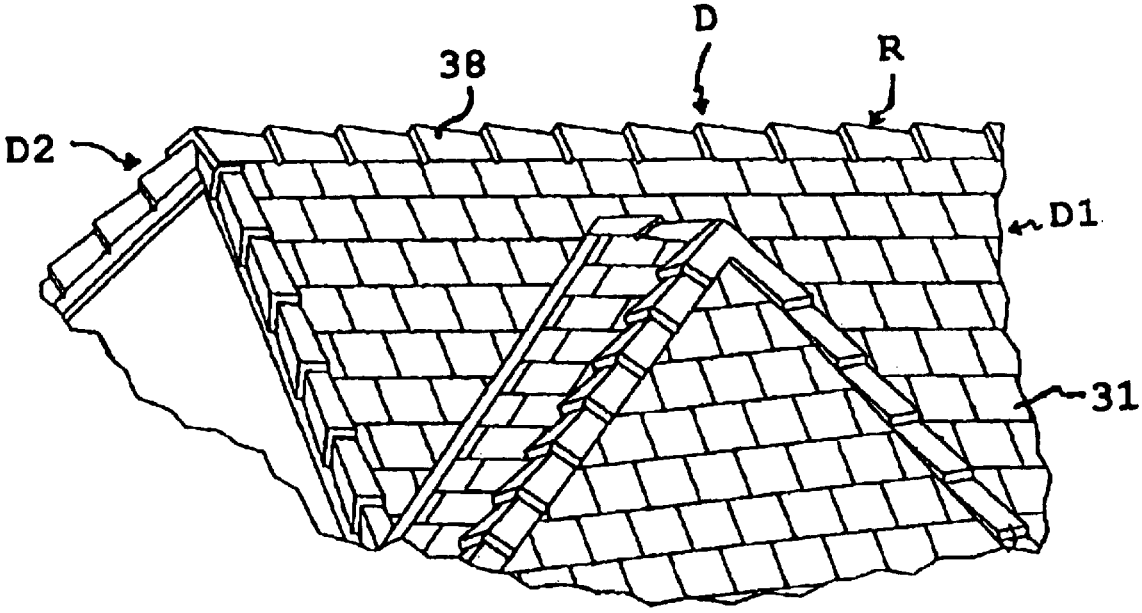
FIG. 2 is a perspective view of a portion of a building roof in accordance with one embodiment of the invention.

FIG. 2 also illustrates a portion of a roof D with roofing tiles 31 and ridge tiles 38 on a roof D with a ridge R.

Figure 3:
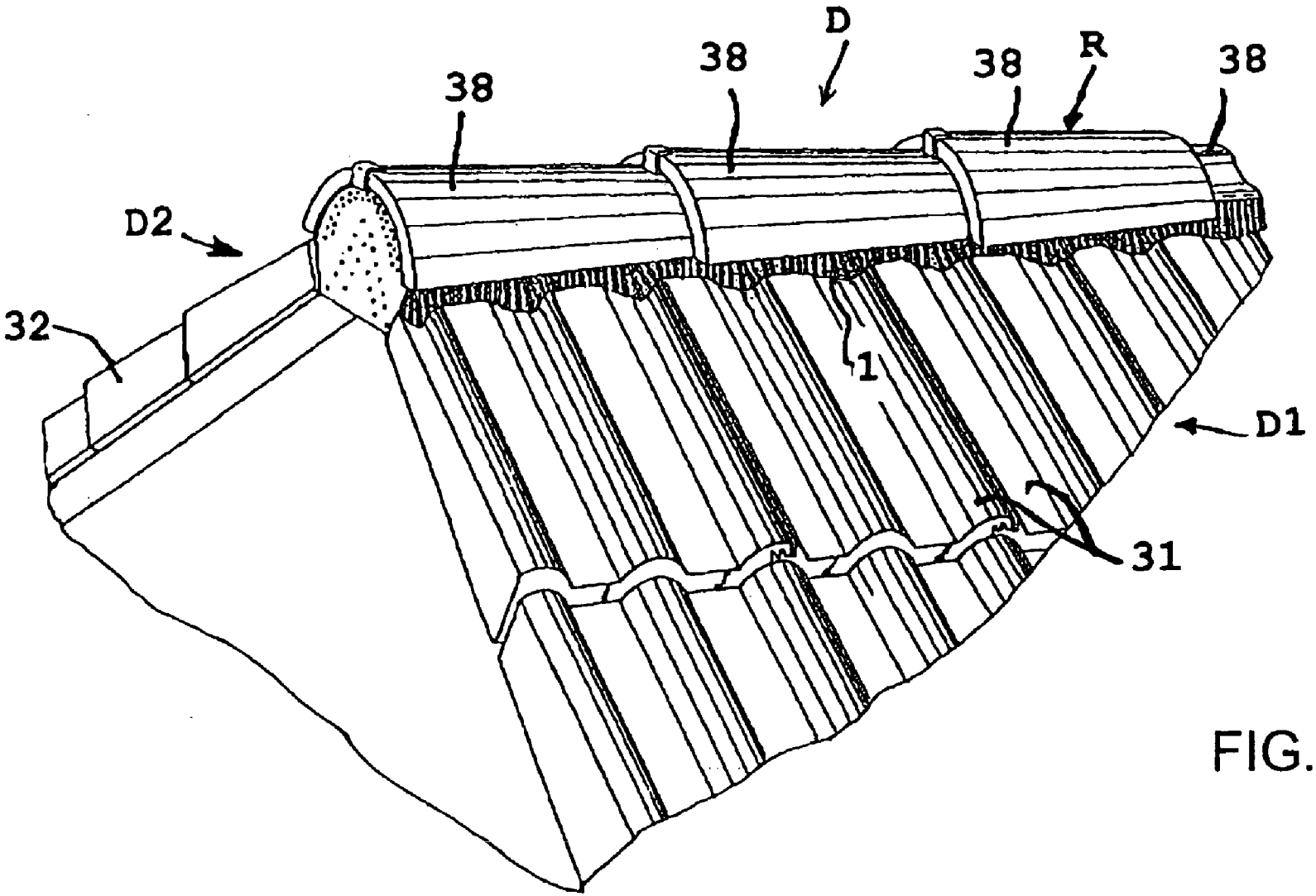
FIG. 3 is a perspective view of a portion of a building roof in accordance with another embodiment of the invention.

FIG. 3 illustrates a portion of an embodiment of a roof with roofing tiles 31 and 32 and ridge tiles 38 and a venting arrangement generally identified by reference numeral 1.

Figure 4:
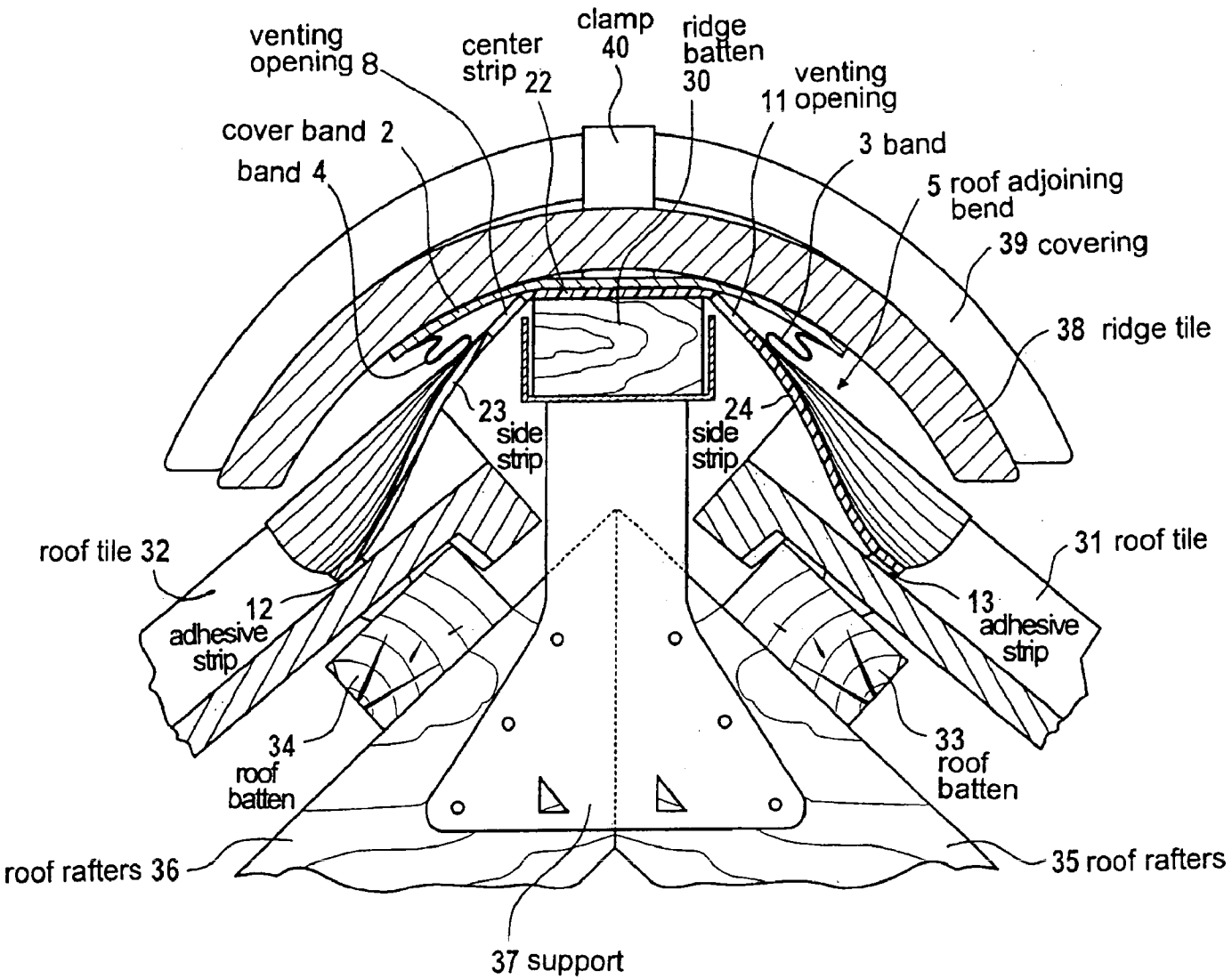
FIG. 4 is a cross section at the ridge of a building roof with an installed air venting arrangement in accordance with one embodiment of the invention.
Figure 4A:
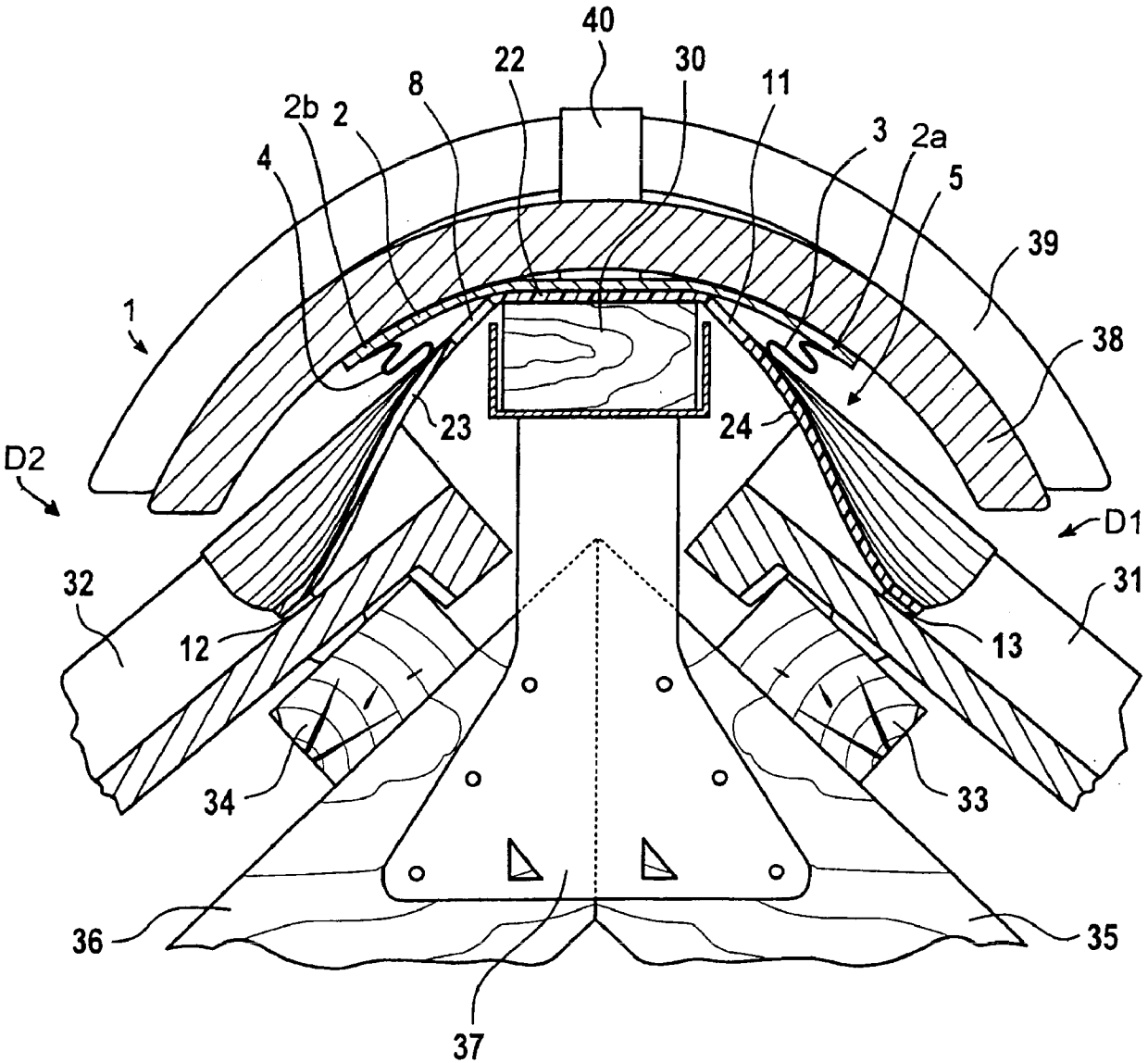
FIG. 4A is a cross section similar to FIG. 4 and identifying additional details.

In FIGS. 4 and 4A is depicted the device 1 after installation in a roof ridge R. The center strip 22 of the roof adjoining band 5 is therein in contact on a ridge batten 30, while the side strips 23, 24 of the roof adjoining band 5 are in contact on roof tiles 31, 32, which in turn, are suspended in roof battens 33, 34. In other words, the roof adjoining band 5 forms part of the venting device or arrangement 1. The roof battens 33, 34 are fastened on roof rafters 35, 36. Connected with the roof rafters 35, 36 is a support 37 for the roof adjoining band 5. In other words, a support 37 for a ridge beam 30 is secured to the roof rafters 35, 36. Over the ridge tile 38 is disposed a covering 39 with a clamp 40.

As is shown in FIGS. 4 and 4A, the venting openings 8, 11 are completely roofed over by the cover band 2 and secured against the side by the air-impermeable bands 3, 4. The cover band 2, which can be a synthetic film or metal foil, is disposed over the venting openings 8, 11 and, as a rigid roof, which adapts to the underside of the ridge tile 38, forms a protection against water, which, in the presence of strong rain and wind, can penetrate from above through the covering 39 of the ridge tile 38. Hereby a shielding, which in cross section has the form of a roof, is formed for the subjacent venting openings 8, 11. In this way, the cover band 2 reliably diverts water which has penetrated into the covering region between the ridge tiles. The cover band 2 serves also as a nail band with which the ridge roll is fastened on the ridge batten 30.

The bands 3, 4 are disposed accordion-like between the cover band 2 and the roof adjoining band 5 comprising venting openings 6 to 11, and welded or adhered with the cover band 2 and the roof adjoining band 5. When laying the device 1, the material composite still flatly rolled up, is fastened centrally through the cover band 2 on the ridge batten 30. The adjoining band 5 of crêped aluminum composite material is subsequently pressed downwardly and formed onto the roof tiles 31, 32 as well as sealed via an adhesive strip 12, 13. The air-permeable bands 3, 4 can also be pulled downwardly due to the folding and spaced at a certain clearance from the venting openings 8, 11 ensure excellent protection against driven water and drift snow.

Since the venting openings 8, 11 are not covered directly by the air-permeable bands 3, 4, they retain their entire cross section of approximately 250 square centimeters per meter ridge.

The device 1 has an active venting area of 1500 square centimeters per meter of ridge roll. In spite of the reduction to 20 to 30% of the air throughput through the air-permeable bands 3, 4, these bands 3, 4 still retain an air throughput, which corresponds to a cross section of more than 300 square centimeters which ensures that even more air passes through the bands 3, 4 than through the venting openings 8, 11.

With reference to FIG. 4A, the central band portion or cover band 2 has a first edge portion 2*a* extending beyond the ridge beam, or ridge batten or ridge pole, 30, and this first edge portion 2*a* is disposed towards the first side D1 of the roof D. The central band portion or cover band 2 has a second edge portion 2*b* disposed opposite the first edge portion 2*a*, with the second edge portion 2*b* extending beyond the ridge beam 30, and this second edge portion 2*b* is disposed towards said the second side D2 of the roof D.

Figure 5:
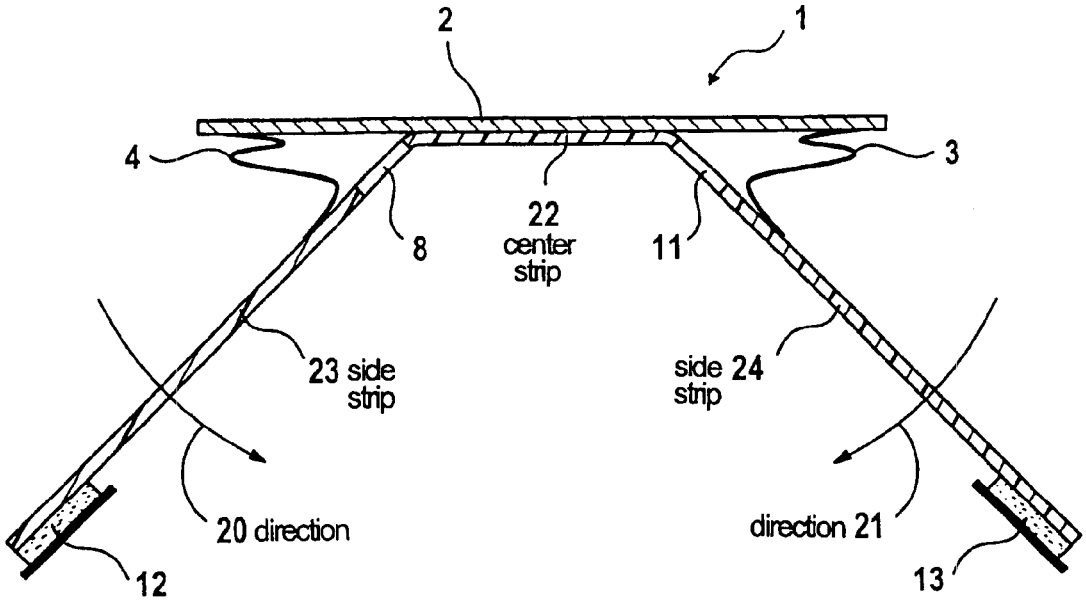
FIG. 5 is a cross section of a venting arrangement in accordance with one embodiment of the invention.
Figure 5A:
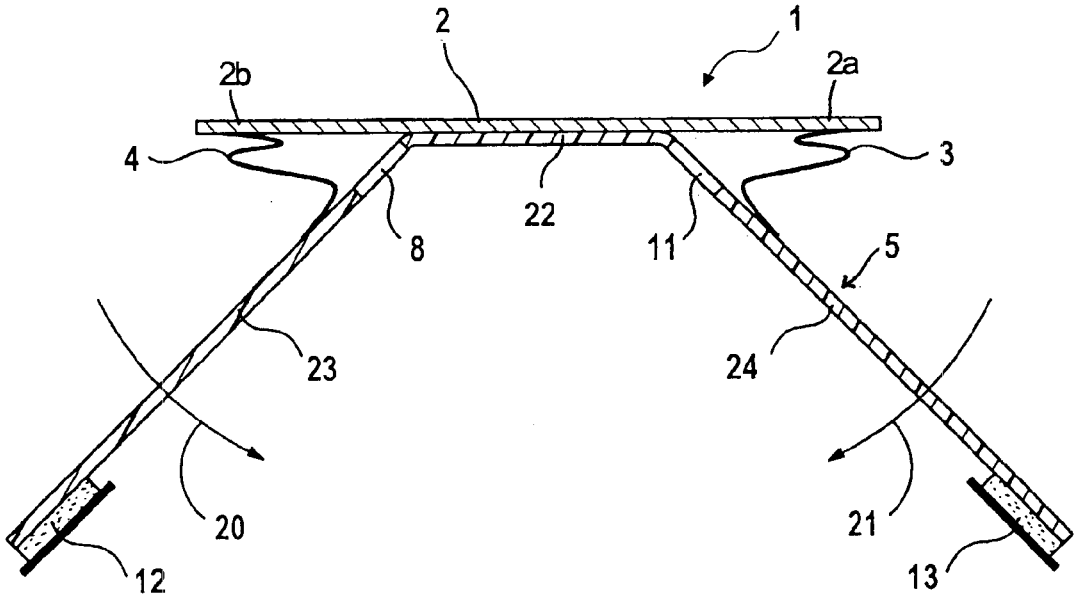
FIG. 5A is a cross section similar to FIG. 5 and identifying additional details.
Figure 8:
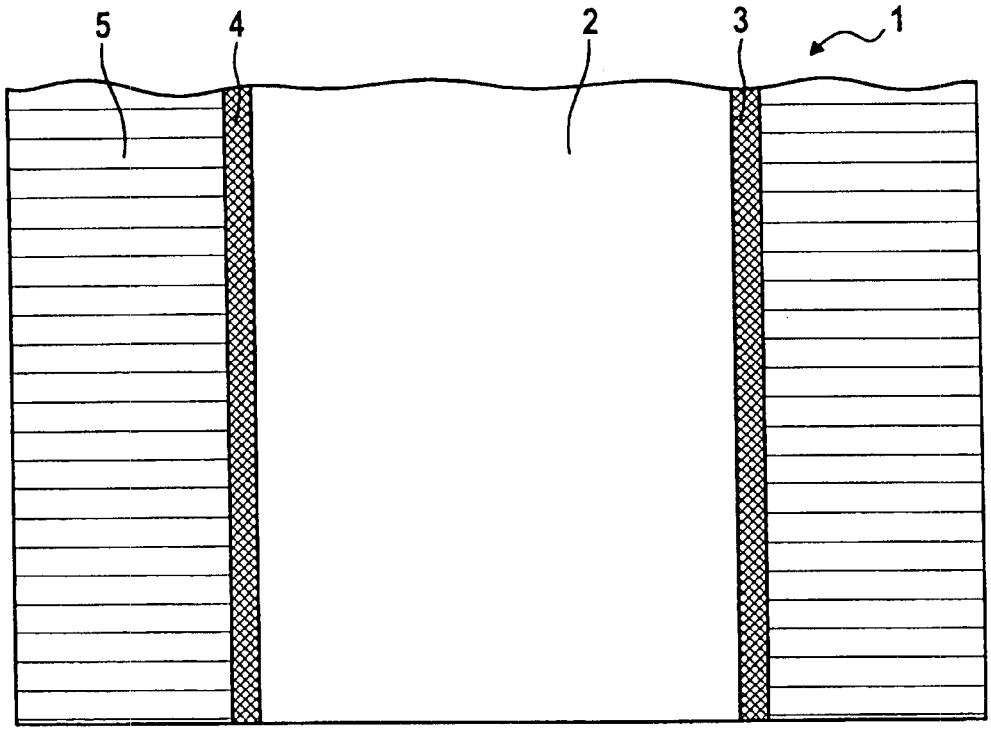
FIG. 8 is a top plan view of a venting arrangement in accordance with one embodiment of the invention.

In FIGS. 5 and 5A the device 1 further shown in FIG. 8 is depicted with the side strips 23, 24 of the roof adjoining band 5 folded downwardly. The unfolding takes place thereby that the right and the left region of the roof adjoining band 5 are moved toward one another in the direction of arrows 20, 21. The right and left regions of the roof adjoining band 5 also form the side strips 23, 24. By unfolding the side strips 23, 24, the fastening points of bands 3, 4 move apart, which is the reason for the bands 3, 4 having an accordion-like folding.

Since only the central region of cover band 2 is adhered with the roof adjoining band 5, the outer regions of the cover band 2 project beyond the onsets of the side strips 23, 24 and in this way form roofings over the venting slots 8, 11. The venting slots 8, 11 are moreover covered over by the air-permeable bands 4, 3, which are developed in the manner of Leporello or accordion folds. In FIGS. 5 and 5A are clearly evident the three regions of the roof adjoining band 5: the center strip 22 and the two side strips 23, 24. The side strips 23, 24 are pliable at least in the longitudinal direction, since they must be formed onto the longer profile lines of the roof pantiles; they can thus be plastically formed-on and stretched. A crêped aluminum composite material is preferably used, which contains an aluminum pliant metal grid, with this pliant metal grid being provided with a rain-proof cover material, for example a nonwoven fabric. However, instead of a nonwoven fabric, a rain-proof synthetic material, for example polyisobutylene, can also be employed.

The embodiments of the invention are not limited to the embodiment example depicted in FIGS. 5 and 5A. It is for example possible to permit the side strips 23, 24 to apply directly on the cover band, i.e., to omit the center strip 22. The cover band 2 in this case lies directly on the ridge batten 30. The side strips 23, 24, nevertheless, can be folded over, which is readily possible through the material properties of the side strips. The connection between side strips 23, 24 and cover band 2 can be completed by adhesion or other suitable measures.

Furthermore, it is not required that the air-permeable, but water-impermeable, bands 3, 4 are developed as bellows. Rather, it is sufficient if they are expandible.

Figure 6:
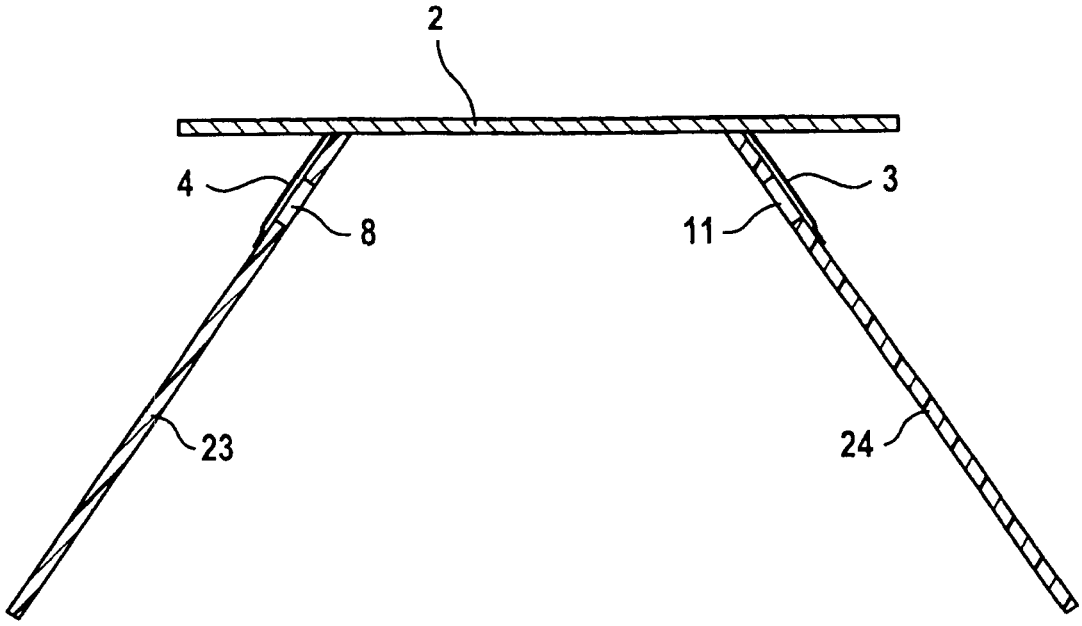
FIG. 6 is a cross section of a venting arrangement in accordance with another embodiment of the invention.
Figure 6A:
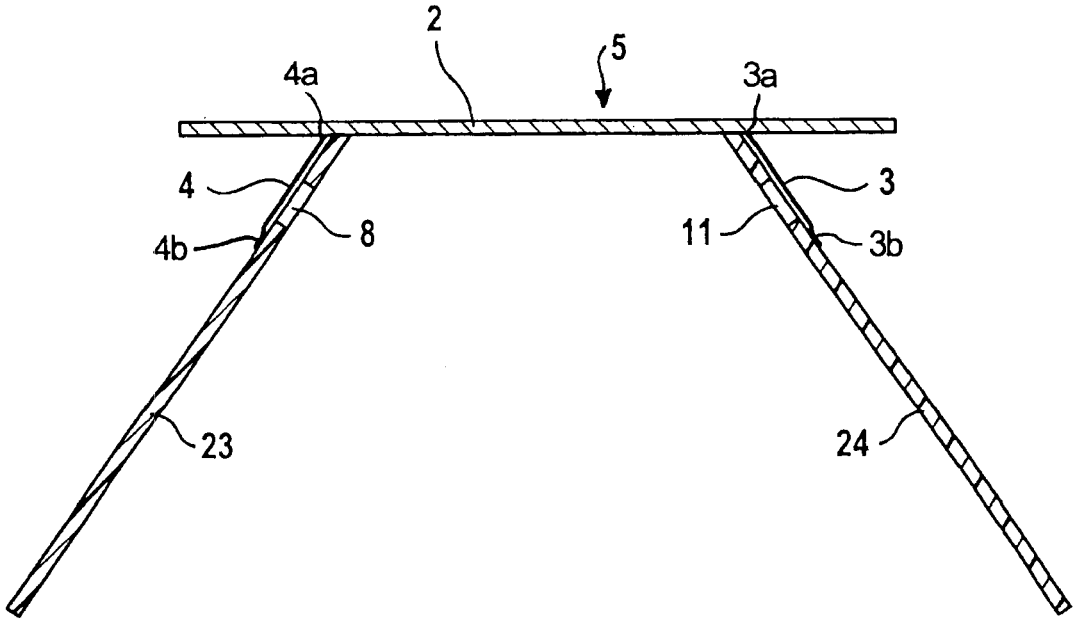
FIG. 6A is a view similar to FIG. 6 and identifying additional details.

FIGS. 6 and 6A show such a variant. It can herein be seen that the center strip 22 has been omitted entirely and the side strips 23, 24 are directly fastened on cover band 2. The fastening can take place by adhesion, for example with the aid of fabric bands. It is only necessary to ensure that the side strips 23, 24 are swivellable relative to the cover band. In addition, the bands 3, 4 extend parallel to the side strips 23, 24, i.e., in contrast to FIGS. 5 and 5A, they do not form a bellows. In FIG. 6A the bands 3, 4 each comprise a first connecting portion 3*a*, 4*a* connected to the central cover band portion 2 and each also comprise a second connecting portion 3*b*, 4*b* connected to corresponding side strips 23, 24.

Figure 7:
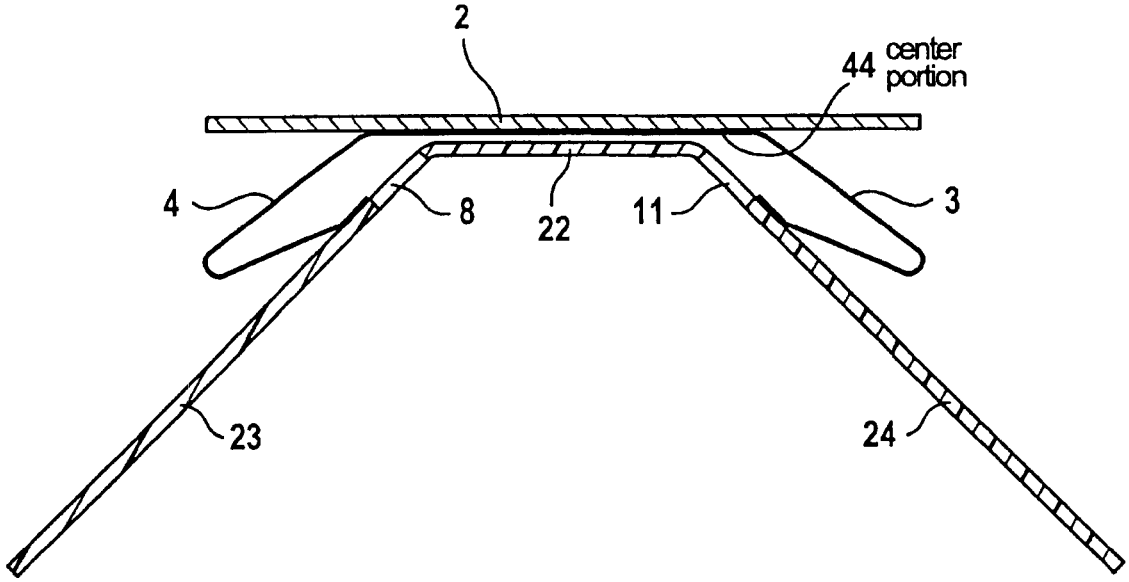
FIG. 7 is a cross section of a venting arrangement in accordance with yet another embodiment of the invention.

FIG. 7 shows a further variant of one embodiment of the invention, in which the two bands 3, 4 are portions of an integral nonwoven fabric. This nonwoven fabric comprises a center portion 44 which does not form folds and which is disposed between the center strip 22 and the cover band. Adjoining this center strip are the two bands 3, 4.

In FIG. 8 is depicted in top view a device 1 for covering and ventilating a roof ridge, which comprises essentially the following parts: a cover band 2, two bands 3, 4 with good air-permeability, and a roof adjoining band 5. The roof adjoining band 5 is implemented integrally and in its central region is connected with the cover band 2. The cover band 2 is preferably a thin synthetic film having a certain rigidity. However, it is also possible to employ a thin metal foil or a reinforced nonwoven fabric. The two bands 3, 4 preferably comprise a nonwoven fabric and are connected with their one end with the roof adjoining band 5 and with its other end with the cover band 2. Instead of a nonwoven fabric, however, woven fabrics or knit fabrics can also be employed.

Figure 9:
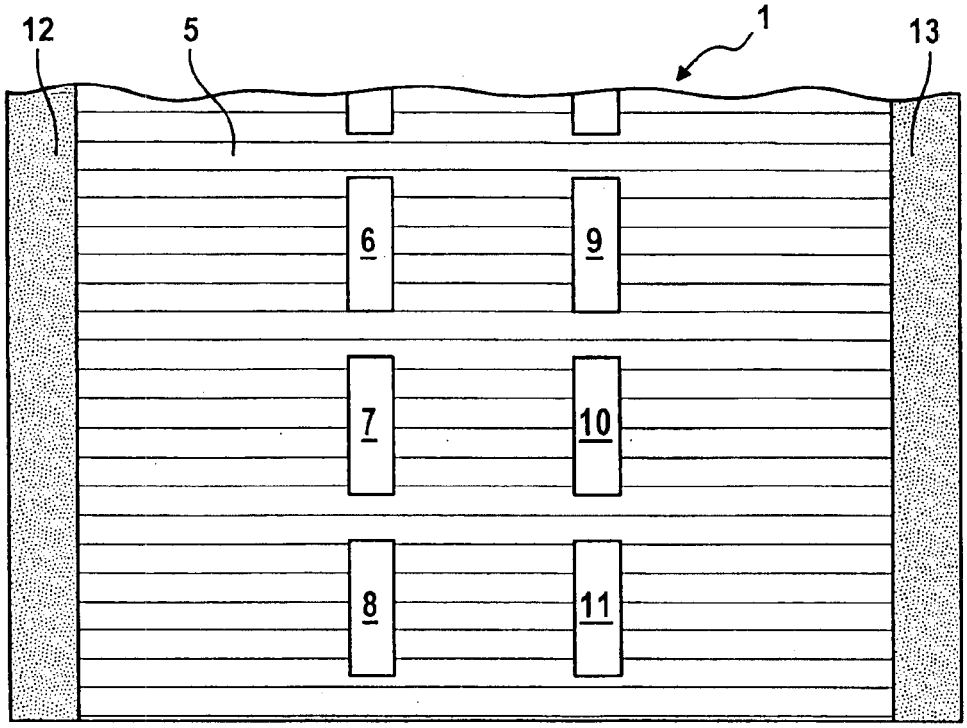
FIG. 9 is a view from below of the venting arrangement according to FIG. 7.

FIG. 9 shows the same device 1 as does FIG. 8, however, in a view from below. The roof adjoining band 5 is herein evident, which is provided in the center with two parallel rows of venting openings 6 to 11, which are developed as slots. On each of the margins of the roof adjoining band 5 an adhesive strip 12, 13 is provided, which is comprised of the adhesive strip proper—for example a butyl bead—and a foil which can be peeled off.

Figure 10:
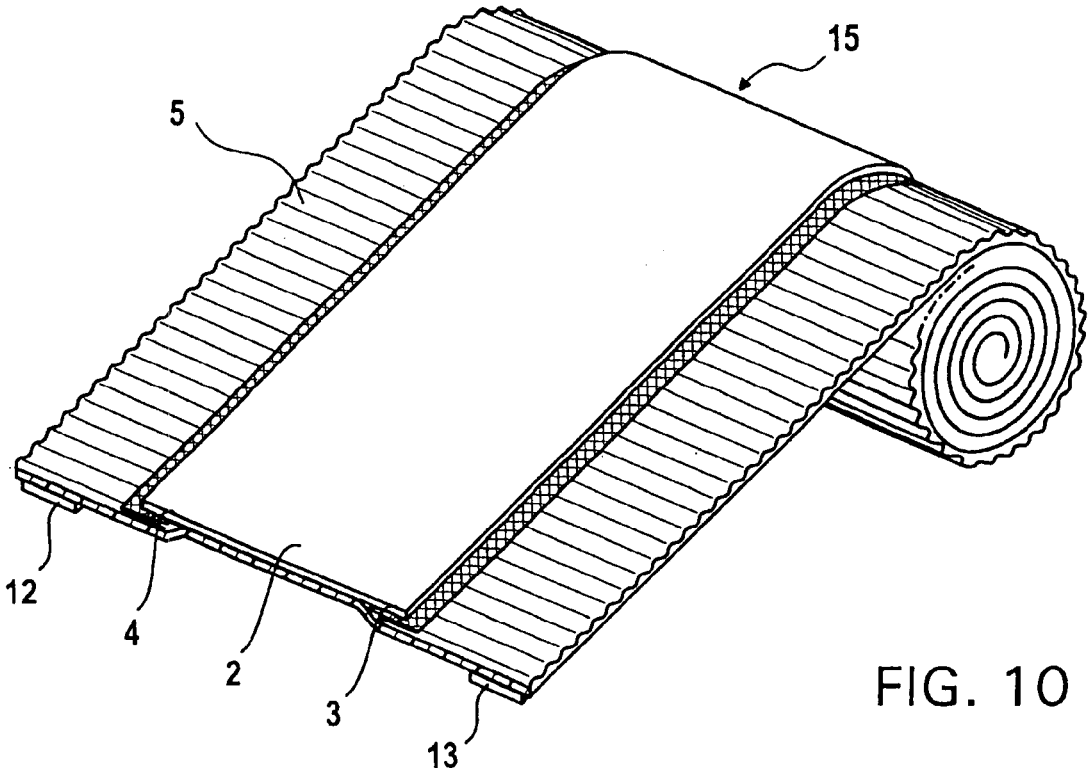
FIG. 10 is a perspective view of a partially rolled-up roll comprising the venting arrangement of FIG. 8

FIGS. 8 and 9 show only a cutaway portion from a longer ridge roll. In FIG. 10 therefore a complete ridge roll 15 is depicted, which is rolled onto a ridge batten on site. Herein is again evident the roof adjoining band 5, the adhesive strips 12, 13, the two air-permeable bands 3, 4 as well as the cover band 2. The cover band 2 is connected in its central region directly with the roof adjoining band 5, for example is adhered or welded. Its margin regions, in contrast, are connected with the nonwoven fabrics 3, 4.

One feature of the invention resides broadly in a device for covering and ventilating a ridge or peak region of a roof, with a central cover band (2), a first side strip (24) provided with venting openings (11) to the right of the center of the cover band (2) and a second side strip (23) provided with venting openings (8) to the left of the center of the cover band (2), characterized in that between the central cover band (2) and the first side strip (24) is provided a first air-permeable, but water-impermeable, band (3), which covers over the venting openings (11) of the first side strip (24), and that between the central cover band (2) and the second side strip (23) is provided a second air-permeable, but water-impermeable, band (4), which covers over the venting openings (8) of the second side strip (23).

Another feature of the invention resides broadly in the device characterized in that the side strips (23, 24) are connected with one another via a center strip (22) and form hereby a roof adjoining band (5), with the cover band (2) being disposed on the center strip (22) of the cover band (5).

Yet another feature of the invention resides broadly in the device characterized in that the cover band (2) is water- and air-tight and covers over the venting openings (6 to 11).

Still another feature of the invention resides broadly in the device characterized in that the air-permeable, but water-impermeable, bands (3, 4) are developed in the manner of an accordion.

A further feature of the invention resides broadly in the device characterized in that the air-permeable, but water-impermeable, bands (3, 4) are developed such that they are extensible.

Another feature of the invention resides broadly in the device characterized in that the air-permeable, but water-impermeable, bands (3, 4) are spaced at a clearance from the venting openings (6 to 11).

Yet another feature of the invention resides broadly in the device characterized in that the air-permeable, but water-impermeable, bands (3, 4) are comprised of nonwoven fabric.

Still another feature of the invention resides broadly in the device characterized in that the water- and air-tight cover band (2) is comprised of synthetic material.

A further feature of the invention resides broadly in the device characterized in that the water- and air-tight cover band (2) is comprised of metal.

Another feature of the invention resides broadly in the device characterized in that each air-permeable, but water-impermeable, band (3, 4) is adhered with one end to the cover band (2) and with its other end to the side strips (23, 24).

Yet another feature of the invention resides broadly in the device characterized in that each air-permeable, but water-impermeable, band (3, 4) is welded with one end to the cover band (2) and with its other end to the side strips (23, 24).

Still another feature of the invention resides broadly in the device characterized in that the roof adjoining band (5) is comprised of crêped aluminum composite material.

A further feature of the invention resides broadly in the device characterized in that the roof adjoining band (5) is fixable on roof tiles (31, 32) through adhesive strips (12, 13).

Another feature of the invention resides broadly in the device characterized in that the adhesive strips (12, 13) are provided at the ends of the side strips (23, 24) of the roof adjoining band (5).

Yet another feature of the invention resides broadly in the device characterized in that underneath the cover band (2) is provided an air-permeable, but water-impermeable, nonwoven fabric (44), whose side regions form the two bands (3, 4).

Still another feature of the invention resides broadly in the device characterized in that a region of the nonwoven fabric is disposed between the cover band (2) and a center strip (22).

The corresponding foreign patent application, namely, Federal Republic of Germany Patent Application, filed on Aug. 9, 2001, having inventor Karl-Heinz HOFMANN, as well as its published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

In one aspect, the invention relates to a device for covering and ventilating a ridge or peak region of a roof. This device comprises a center strip and two side strips, with the center strip, which can be placed onto a ridge batten, being covered by an additional cover band. This additional cover band is only connected with the center strip such that the pliable side strips can be folded downwardly and be formed onto the top side of roof tiles. On both sides of the ridge batten are disposed venting openings, which are shielded by the cover band at a clearance. So that no rain or drift snow can penetrate through the venting openings into the ridge, on the longitudinal margins of the cover band and underneath the venting openings an air-permeable nonwoven shielding fabric is fastened on the side strips. As long as the ridge element is rolled up, the nonwoven shielding fabric is disposed with folds one on top of the other between the cover band and the side strips. After unrolling on the ridge batten and after the side strips have been unwound, the nonwoven shielding fabric, however, unfolds in the manner of an accordion.

The components disclosed in the various publications, disclosed or incorporated by reference herein, may be used in the embodiments of the present invention, as well as equivalents thereof.

Some examples of roofs and roofing materials in which embodiments of the present invention may possibly be utilized may be found in the following U.S. Pat. No. 3,423,898 issued to Tracy et al. on Jan. 28, 1969 and entitled "Roof framing system;" U.S. Pat. No. 3,596,941 issued to Tracy on Aug. 3, 1971 and entitled "Selectively adjustable roof bracket;" U.S. Pat. No. 5,377,459 issued to Freiborg on Jan. 3, 1995 and entitled "Ridge cover and shingle and method of making and using the same;" U.S. Pat. No. 5,389,715 issued to Davis et al. on Feb. 14, 1995 and entitled "Polymer blends for rooftop curable heat seamable roof sheeting and method for covering roofs;" U.S. Pat. No. 5,395,703 issued to Carey, II et al. on Mar. 7, 1995 and entitled "Hot dip terpene coated roofing material;" U.S. Pat. No. 5,400,558 issued to Hannah et al. on Mar. 28, 1995 and entitled "Roofing shingle square;" U.S. Pat. No. 5,406,764 issued to Van Auken et al. on Apr. 18, 1995 and entitled "Mesh roof facing system;" U.S. Pat. No. 5,421,134 issued to Hannah et al. on Jun. 6, 1995 and entitled "Roofing shingle;" U.S. Pat. No. 5,437,923 issued to Kalkanoglu on Aug. 1, 1995 and entitled "Halogen-free flame-regardant bitumen roofing composition;" U.S. Pat. No. 5,440,855 issued to Loucks on Aug. 15, 1995 and entitled "Roofing structure and method;" U.S. Pat. No. 5,471,801 issued to Kupczyk et al. on Dec. 5, 1995 and entitled "Hip and ridge asphalt roof covering;" U.S. Pat. No. 5,474,838 issued to Callaway et al. on Dec. 12, 1995 and entitled "Roofing membrane comprising fiberglass scrim stitched to a polyester mat;" U.S. Pat. No. 5,738,581 issued to Rickert et al. on Apr. 14, 1998 and entitled "Roof ventilation element;" U.S. Pat. No. 5,740,634 issued to Schade on Apr. 21, 1998 and entitled "Sealing strip for a roof ridge or arris cover;" U.S. Pat. No. 6,015,343 issued to Castillo et al. on Jan. 18, 2000 and entitled "Tile roof vent;" and U.S. Pat. No. 6,286,273 issued to Villela et al. on Sep. 11, 2001 and entitled "Tile vent;" All of the patents cited herein are hereby expressly incorporated by reference as if fully set forth in their entirety herein.

The appended drawings in their entirety, including all dimensions, proportions and/or shapes in at least one embodiment of the invention, are accurate and are hereby included by reference into this specification.

Some examples of polyisobutylene materials which may possibly be used in embodiments of the present invention may be found in the following U.S. Pat. No. 5,389,430 issued to Yilgör et al. on Feb. 14, 1995 and entitled "Textiles coated with waterproof, moisture vapor permeable polymers;" U.S. Pat. No. 5,496,615 issued to Bartlett et al. on Mar. 5, 1996 and entitled "Waterproofing membrane;" U.S. Pat. No. 5,521,273 issued to Yilgör et al on May 28, 1996 and entitled "Waterproof, moisture vapor permeable polymers, films and coated textiles and other materials;" U.S. Pat. No. 5,615,526 issued to Palmer et al. on Apr. 1, 1997 and entitled "Drains for single layer synthetic roofing and waterproofing membranes;" U.S. Pat. No. 5,665,823 issued to Saxena et al. on Sep. 9, 1997 and entitled "Polyisobutylene polymers having acrylic functionality;" U.S. Pat. No. 6,258,439 issued to Hofmann on Jul. 10, 2001 and entitled "Roofing material for covering the roof of a building which covering material can be plastically deformed by hand;" U.S. Pat. No. 6,350,810 issued to Gaveske on Feb. 26, 2002 and entitled "Method and composition for waterproofing;" and U.S. Pat. No. 6,418,687 issued to Cox on Jul. 16, 2002 and entitled "Insulated roofing system." All of the patents cited herein are hereby expressly incorporated by reference as if fully set forth in their entirety herein.

All, or substantially all, of the components and methods of the various embodiments may be used with at least one embodiment or all of the embodiments, if more than one embodiment is described herein.

Some examples of crepe-like materials or processes for making crepe-like materials which may possibly be used in embodiments of the present invention may be found in the following U.S. Pat. No. 5,403,446 issued to Trelsmo et al. on Apr. 4, 1995 and entitled "Apparatus for adjusting creping conditions;" U.S. Pat. No. 5,740,634 issued to Schade on Apr. 21, 1998 and entitled "Sealing strip for a roof ridge or arris cover;" U.S. Pat. No. 6,258,439 issued to Hofmann on Jul. 10, 2001 and entitled "Roofing material for covering the roof of a building which covering material can be plastically deformed by hand;" and U.S. Pat. No. 6,355,333 issued to Waggoner et al. on Mar. 12, 2002 and entitled "Construction membrane;" and in the following foreign patent publications: Federal Republic of Germany Pat. No. 42 41 070 issued to Fleck on Feb. 17, 1994; European Pat. No. EP0244023 published on Nov. 4, 1987 having inventors Hyac et al.; and European Patent Application 0 997 589 published on May 3, 2000 having inventor Schürmann. All of the patents and patent publications cited herein are hereby expressly incorporated by reference as if fully set forth in their entirety herein.

All of the patents, patent applications and publications recited herein, and in the Declaration attached hereto, are hereby incorporated by reference as if set forth in their entirety herein.

Some examples of nonwoven polyesters which may possibly be used in embodiments of the present invention may be found in the following U.S. Pat. No. 5,151,146 issued to Green on Sep. 29, 1992 and entitled "Method of making a roofing laminate including a triaxial wound nonwoven fiberglass scrim;" U.S. Pat. No. 5,380,582 issued to Neely, Jr. et al. on Jan. 10, 1995 and entitled "Recyclable bale wrap made from a thermally bonded, needle-punched, polyester nonwoven;" U.S. Pat. No. 5,415,738 issued to Mehta et al. on May 16, 1995 and entitled "Wet-laid non-woven fabric and method for making same;" U.S. Pat. No. 5,419,953 issued to Chapman on May 30, 1995 and entitled "Multilayer composite air filtration media;" U.S. Pat. No. 5,429,066 issued to Lewit et al. on Jul. 4, 1995 and entitled "Composite structures and method of making composite structures;" and U.S. Pat. No. 6,296,921 issued to Blackmore et al. on Oct. 2, 2001 and entitled "Composite fabric." All of the patents cited herein are hereby expressly incorporated by reference as if fully set forth in their entirety herein. All of the references and documents, cited in any of the documents cited herein, and the references they are in turn cited in are hereby incorporated by reference as if set forth in their entirety herein. All of the documents cited herein, referred to in the immediately preceding sentence, include all of the patents, patent applications and publications cited anywhere in the present application. All of the references included herein as aforesaid include the corresponding equivalents published by the United States Patent and Trademark Office and elsewhere.

Some examples of acrylonitrile nonwoven materials which may possibly be incorporated in embodiments of the present invention may be found in the following U.S. Pat. No. 5,385,774 issued to Cramer et al. on Jan. 31, 1995 and entitled "Roof material;" U.S. Pat. No. 5,397,627 issued to Dunbar et al. on Mar. 14, 1995 and entitled "Fabric having reduced air permeability;" U.S. Pat. No. 5,401,576 issued to Yoon et al. on Mar. 28, 1995 and entitled "Heat- and chemical-resistant acrylic short fibers without spinning;" U.S. Pat. No. 5,434,205 issued to Fishman on Jul. 18, 1995 and entitled "Acrylonitrile polymer compositions and articles and methods for their preparation;" U.S. Pat. No. 5,468,529 issued to Kwon et al. on Nov. 21, 1995 and entitled "Magnetic filter material comprising a self-bonding nonwoven fabric of continuous thermoplastic fibers;" and U.S. Pat. No. 5,470,485 issued to Morweiser et al. on Nov. 28, 1995 and entitled "Electrostatically-effective air filter material." All of the patents cited herein are hereby expressly incorporated by reference as if fully set forth in their entirety herein.

The details in the patents, patent applications and publications may be considered to be incorporable, at Applicant's option, into the claims during prosecution as further limitations in the claims to patentably distinguish any amended claims from any applied prior art.

Some examples of aluminum composite materials, features of which may possibly be incorporated in embodiments of the present invention may be found in the following U.S. Pat. No. 4,013,812 issued to Geiger on Mar. 2, 1977 and entitled "Laminated fabric;" U.S. Pat. No. 4,073,998 issued to O'Connor on Feb. 14, 1978 and entitled "Scrim/foil laminate;" U.S. Pat. No. 4,396,665 issued to Rowe on Aug. 2, 1983 and entitled "Self-adhesive roofing laminates having metal layer therein;" U.S. Pat. No. 4,585,682 issued to Colarusso et al. on Apr. 29, 1986 and entitled "Roofing membranes;" U.S. Pat. No. 5,740,634 issued to Schade on Apr. 21, 1998 and entitled "Sealing strip for a roof ridge or arris cover;" and U.S. Pat. No. 6,308,482 issued to Strait on Oct. 30, 2001 and entitled "Reinforced roof underlayment and method of making the same." All of the patents cited herein are hereby expressly incorporated by reference as if fully set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

Some examples of adhesives which may possibly be incorporated in embodiments of the present invention may be found in the following U.S. Pat. No. 5,569,430 issued to Callaway et al. on Oct. 29, 1996 and entitled "Method of making a roofing membrane;" U.S. Pat. No. 5,740,634 issued to Schade on Apr. 21, 1998 and entitled "Sealing strip for a roof ridge or arris cover;" U.S. Pat. No. 5,895,536 issued to Starr et al. on Apr. 20, 1999 and entitled "Method of adhering roof tiles using one-component adhesive and roof construction obtained thereby;" U.S. Pat. No. 5,951,796 issued to Murray on Sep. 14, 1999 and entitled "Two component polyurethane construction adhesive and method of using same;" and U.S. Pat. No. 6,164,021 issued to Huber et al. on Dec. 26, 2000 and entitled "Hip and ridge sealing and attachment system and method of using same;" and U.S. Pat. No. 6,314,700 issued to Starr and entitled "Roof tile construction using sandwiched adhesive." All of the patents cited herein are hereby expressly incorporated by reference as if fully set forth in their entirety herein.

The following U.S. patents, of the Assignee herein, are hereby expressly incorporated by reference as if fully set forth in their entirety herein. These U.S. patents relate to roofing materials and roofing details, features of which may possibly be incorporated in embodiments of the present invention, namely: U.S. Pat. No. 6,119,415 issued to Rinklake et al. on Sep. 19, 2000 and entitled "Pitched roof with an energy collection system;" U.S. Pat. No. 6,182,404 issued to Rinklake et al. on Feb. 6, 2001 and entitled "Sub-roofing element, on a roof for a flat, plate-shaped structural element;" and U.S. Pat. No. 6,105,331 issued to Rinklake et al. on Aug. 22, 2000 and entitled "Joist element for fastening a flat, plate-shaped structural element to a pitched roof."

One feature of the invention resides broadly in a building (B) having a pitched, sculptured tile roof (D) with a ridge (R) extending atop said pitched, sculptured tile roof (D);

said building (B) comprising walls (W);

said pitched, sculptured tile roof (D) being supported by said walls (W);

said pitched, sculptured tile roof (D) comprising:

a ridge beam (30) disposed at said ridge (R) of said pitched, sculptured tile roof (D);

said ridge beam (30) having a predetermined length to provide a length dimension of said pitched, sculptured tile roof (D); said ridge beam (30) having a first end and a second end remote from said first end;

a plurality of roof rafter pairs (35, 36), each comprising a first roof rafter (35) and a second roof rafter (36);

each said first roof rafter (35) being disposed between a corresponding wall (W) and said ridge beam (30) at a predetermined angle of inclination at a first pitched side (D1) of said pitched, sculptured tile roof (D);

each said second roof rafter (36) being disposed between a corresponding wall (W) and said ridge beam (30) at a predetermined angle of inclination at a second pitched side (D2) of said pitched, sculptured tile roof;

a plurality of roof battens (33, 34) comprising a first, uppermost, roof batten (33) disposed on said first side (D1) of said pitched, sculptured tile roof (D), and also comprising a second, uppermost, roof batten (34) disposed on said second side (D2) of said pitched, sculptured tile roof (D);

each roof batten (33, 34) having a length dimension, each roof batten length dimension being disposed substantially parallel to the direction of said length dimension of said ridge beam (30);

a plurality of sculptured roofing tiles (31, 32) which form a three dimensional structured surface disposed on said pitched, sculptured-tiled roof;

said plurality of sculptured roofing tiles (31, 32) comprising a first, uppermost, row of roofing tiles (31) disposed substantially adjacent said ridge beam (30) on said first, uppermost, roof batten (33) on said first pitched side (D1) of said pitched, sculptured roof (D); and said plurality of roofing tiles (31, 32) comprising a second, uppermost, row of roofing tiles (32) disposed substantially adjacent said ridge beam (30) on said second, uppermost, roof batten (34) at said second pitched side (D2) of said pitched, structured tile roof (D);

a plurality of ridge tiles (38) disposed in a row atop said ridge beam (30) between said first and second ends of said ridge beam (30); and a venting arrangement (1) configured and dimensioned to vent air from beneath said roof to the outside of said roof, and also configured to substantially minimize passage of water from the outside of said roof to beneath said roof;

said venting arrangement (1) comprising:

a central band portion (2) being disposed between said row of ridge tiles (38) and said ridge beam (30);

said central band portion (2) comprising a first edge portion (2*a*) extending beyond said ridge beam (30) and being disposed towards said first side (D1) of said pitched, sculptured tile roof (D); and said central band portion (2) comprising a second edge portion (2*b*) disposed opposite said first edge portion (2*a*); said second edge portion (2*b*), extending beyond said ridge beam (30) and being disposed towards said second side of said roof;

a first side strip (24), connected to said first edge portion (2*a*) of said central band portion (2), and being dimensioned and disposed to cover at least a portion of said first, uppermost, row of sculptured roofing tiles (31);

said first side strip (24) comprising a plurality of first venting openings (11) configured and dimensioned to provide a venting path for air from beneath said first side (D1) of said pitched, sculptured tile roof (D) to the outside of said pitched, sculptured tile roof (D);

a second side strip (23), connected to said second edge portion (2*b*) of said central band portion (2), and being dimensioned and disposed to cover at least a portion of said second, uppermost, row of sculptured roofing tiles (32);

said second side strip (23) comprising a plurality of second venting openings (8) configured and dimensioned to provide a venting path for air from beneath said second side (D2) of said pitched, sculptured tile roof (D) to the outside of said pitched, sculptured tile roof (D);

a first band (3), comprising a material being configured and dimensioned to permit passage of air through said first venting openings (11) and through said first band (3), and said material being configured and dimensioned to substantially minimize passage of water through said first band (3) and said first venting (11), said first band being connected to said central band portion (2) and also to said first side strip (24), and being disposed substantially adjacent said first venting openings (11); and a second band (4), comprising a material being configured and dimensioned to permit passage of air through said second venting openings (8) and through said second band (4), and said material being configured and dimensioned to substantially minimize passage of water through said second band (4) and through said second venting openings (8), said second band (4) being connected to said central band portion (2) and also to said second side strip (23), and being disposed substantially adjacent said second venting openings (8).

Another feature of the invention resides broadly in a pitched tile roof venting arrangement on a pitched tile roof, said pitched tile roof (D) comprising: a first side (D1) and a second side (D2) opposite said first side (D1), a first, uppermost, row of roofing tiles (31) disposed on said first side (D1) of said roof (D), a second, uppermost, row of roofing tiles (32) disposed on said second side (D2) of said roof (D), a ridge beam (30), and a row of ridge tiles (38) disposed on said ridge beam (30);

said pitched tile roof venting arrangement comprising:

a central band portion (2) configured and dimensioned to be disposed between said row of ridge tiles (38) and said ridge beam (30) on said pitched tile roof (D);

a first side strip (24), connected to said central band portion (2), being disposed to cover at least a portion of said first, uppermost, row of roofing tiles (31) on said first side (D1) of said pitched tile roof (D);

said first side strip (24) comprising a plurality of first venting openings (11) configured and dimensioned to provide a venting path for air from beneath said first side (D1) of said pitched tile roof (D) to the outside of said pitched tile roof (D);

a second side strip (23), connected to said central band portion (2) opposite said first side strip (24); said second side strip (23) being disposed to cover at least a portion of a second, uppermost, row of roofing tiles (32) on said second side (D2) of a pitched tile roof (D);

said second side strip (23) comprising a plurality of second venting openings (8) configured and dimensioned to provide a venting path for air from beneath said second side (D2) of said pitched tile roof (D) to the outside of said pitched tile roof (D);

a first band (3), comprising an air-permeable and substantially water-impermeable material, connected between said central band portion (2) and said first side strip (24), and being configured and dimensioned to be disposed substantially adjacent said first venting openings (11) of said first side strip (24), to permit passage of air through said first venting openings (11) and through said first band (3) and to minimize passage of water through said first venting openings (11); and a second band (4), comprising an air-permeable and substantially water-impermeable material, connected between said central band portion (2) and said second side strip (23), being configured and dimensioned to be disposed substantially adjacent said second venting openings (8) of said second side strip (23), to permit passage of air through said second venting openings (8) and through said second band (4) and to minimize passage of water through said second venting openings (8).

Yet another feature of the invention resides broadly in a pitched tile roof venting arrangement on a building (B) having walls and a pitched, sculptured tile roof (D) with a ridge (R) extending atop said pitched, sculptured tile roof (D); the pitched, sculptured tile roof (D) being supported by the walls (W); said pitched tile roof comprising: a ridge beam (30) being disposed at the ridge (R) of the pitched, sculptured tile roof (D), the ridge beam (30) having a predetermined length to provide a length dimension of the pitched, sculptured tile roof (D), the ridge beam (30) having a first end and a second end remote from the first end; a plurality of roof rafter pairs (35, 36), each comprising a first roof rafter (35) and a second roof rafter (36), each first roof rafter (35) being disposed between a corresponding wall (W) and the ridge beam (30) at a first pitched side (D1) of the pitched, sculptured tile roof (D), each second roof rafter (36) being disposed between a corresponding wall (W) and the ridge beam (30) at a second pitched side (D2) of the pitched, sculptured tile roof; a plurality of roof battens (33, 34) comprising a first, uppermost, roof batten (33) disposed on the first side (D1) of the pitched, sculptured tile roof (D), and comprising a second, uppermost, roof batten (34) disposed on the second side (D2) of the pitched, sculptured tile roof (D), each roof batten (33, 34) having a length dimension, each roof batten length dimension being disposed substantially parallel to the direction of the length dimension of the ridge beam (30); a plurality of sculptured roofing tiles (31, 32) forming a three dimensional structured surface disposed on the pitched, sculptured-tiled roof, the plurality of sculptured roofing tiles (31, 32) comprising a first, uppermost, row of roofing tiles (31) disposed substantially adjacent the ridge beam (30) on the first, uppermost, roof batten (33) on the first pitched side (D1) of the pitched, sculptured roof (D), and the plurality of roofing tiles (31, 32) comprising a second, uppermost, row of roofing tiles (32) disposed substantially adjacent the ridge beam (30) on the second, uppermost, roof batten (34) at the second pitched side (D2) of the pitched, structured tile roof (D); and a plurality of ridge tiles (38) being disposed in a row atop the ridge beam (30) between the first and second ends of the ridge beam (30);

said pitched tile roof venting arrangement on a building having walls and a pitched tile roof, comprising:

a central band portion (2) disposed between the row of ridge tiles (38) and the ridge beam (30) on the pitched tile roof (D);

a first side strip (24), connected to said central band portion (2) covering at least a portion of the first, uppermost, row of roofing tiles (31) on the first side of the pitched tile roof (D);

said first side strip (24) comprising a plurality of first venting openings (11) configured and dimensioned to provide a venting path for air from beneath at least the first side (D1) of the pitched tile roof (D) to the outside of the pitched tile roof (D);

a second side strip (23), connected to said central band portion (2) opposite said first side strip (24); said second side strip (23) covering at least a portion of the second, uppermost, row of roofing tiles (32) on the second side (D2) of the pitched tile roof (D);

said second side strip (23) comprising a plurality of second venting openings (8) configured and dimensioned to provide a venting path for air from beneath at least the second side (D2) of the pitched tile roof (D) to the outside of the pitched tile roof (D);

a first band (3), comprising an air-permeable and substantially water-impermeable material, connected between said central band portion (2) and said first side strip (24), and being disposed substantially adjacent said first venting openings (11) of said first side strip (24) to permit passage of air through said first venting openings (11) and through said first band (3) and to minimize passage of water through said first venting openings (8); and a second band (4), comprising an air-permeable and substantially water-impermeable material, connected between said central band portion (2) and said second side strip (23), and being disposed substantially adjacent said second venting openings (8) of said second side strip (23) to permit passage of air through said second venting openings (8) and through said second band (4) and to minimize passage of water through said second venting openings (8).

Still another feature of the invention resides broadly in a pitched tile roof venting arrangement (1) of a pitched tile roof (D) having a first side (D1) and a second side (D1), said pitched tile roof venting arrangement (1) comprising:

a central band portion (2) being configured and dimensioned to be disposed over a ridge beam (30) on a pitched tile roof (D);

a first side strip (24) and a second side strip (23), each connected to opposite sides of said central band portion (2);

each side strip (23, 24) being configured and dimensioned to be disposed to cover at least a portion of an uppermost row of roofing tiles (31, 32) on each side of a pitched tile roof (D);

each side strip (23) comprising a plurality of venting openings (6–11) configured and dimensioned to provide a venting path for air from beneath a pitched tile roof (D) to the outside of a pitched tile roof; and a first band (3) and a second band (4), each comprising an air-permeable and substantially water-impermeable material, connected between said central band portion (2) and a corresponding one of the side strips (23, 24) and each band (3, 4) being configured and dimensioned to be disposed substantially adjacent corresponding venting openings, to permit passage of air through said venting openings and through each venting band (3, 4) and to minimize passage of water through said venting openings (6–11).

A further feature of the invention resides broadly in a building (B) having a pitched, sculptured tile roof (D) with a ridge (R) extending atop said pitched, sculptured tile roof (D);

said building (B) comprising walls (W);

said pitched, sculptured tile roof (D) being supported by said walls (W);

said pitched, sculptured tile roof (D) comprising:

a ridge beam (30) disposed at said ridge (R) of said pitched, sculptured tile roof (D);

said ridge beam (30) having a predetermined length to provide a length dimension of said pitched, sculptured tile roof (D); said ridge beam (30) having a first end and a second end remote from said first end;

a plurality of roof rafter pairs (35, 36), each comprising a first roof rafter (35) and a second roof rafter (36);

each said first roof rafter (35) being disposed between a corresponding wall (W) and said ridge beam (30) at a predetermined angle of inclination at a first pitched side (D1) of said pitched, sculptured tile roof (D);

each said second roof rafter (36) being disposed between a corresponding wall (W) and said ridge beam (30) at a predetermined angle of inclination at a second pitched side (D2) of said pitched, sculptured tile roof;

a plurality of roof battens (33, 34) comprising a first, uppermost, roof batten (33) disposed on said first side (D1) of said pitched, sculptured tile roof (D), and also comprising a second, uppermost, roof batten (34) disposed on said second side (D2) of said pitched, sculptured tile roof (D);

each roof batten (33, 34) having a length dimension, each roof batten length dimension being disposed substantially parallel to the direction of said length dimension of said ridge beam (30);

a plurality of sculptured roofing tiles (31, 32) which form a three dimensional structured surface disposed on said pitched, sculptured tile roof;

said plurality of sculptured roofing tiles (31, 32) comprising a first, uppermost, row of roofing tiles (31) disposed substantially adjacent said ridge beam (30) on said first, uppermost, roof batten (33) on said first pitched side (D1) of said pitched, sculptured roof (D); and said plurality of roofing tiles (31, 32) comprising a second, uppermost, row of roofing tiles (32) disposed substantially adjacent said ridge beam (30) on said second, uppermost, roof batten (34) at said second pitched side (D2) of said pitched, structured tile roof (D);

a plurality of ridge tiles (38) disposed in a row atop said ridge beam (30) between said first and second ends of said ridge beam (30); and a venting arrangement (1) configured and dimensioned to vent air from beneath said roof to the outside of said roof, and also configured to substantially minimize passage of water from the outside of said roof to beneath said roof;

said venting arrangement (1) comprising:

a central band portion (2) being disposed between said row of ridge tiles (38) and said ridge beam (30);

a first side strip (24), connected to said central band portion (2), and being dimensioned and disposed to cover at least a portion of said first, uppermost, row of sculptured roofing tiles (31);

said first side strip (24) comprising a plurality of first venting openings (11) configured and dimensioned to provide a venting path for air from beneath said first side (D1) of said pitched, sculptured tile roof (D) to the outside of said pitched, sculptured tile roof (D);

a second side strip (23), connected to said central band portion (2), and being dimensioned and disposed to cover at least a portion of said second, uppermost, row of sculptured roofing tiles (32);

said second side strip (23) comprising a plurality of second venting openings (8) configured and dimensioned to provide a venting path for air from beneath said second side (D2) of said pitched, sculptured tile roof (D) to the outside of said pitched, sculptured tile roof (D);

a first band (3), comprising a material being configured and dimensioned to permit passage of air through said first venting openings (11) and through said first band (3), and said material being configured and dimensioned to substantially minimize passage of water through said first band (3) and said first venting openings (11), said first band being connected to said central band portion (2) and also to said first side strip (24), and being disposed substantially adjacent said first venting openings (11); and a second band (4), comprising a material being configured and dimensioned to permit passage of air through said second venting openings (8) and through said second band (4), and said material being configured and dimensioned to substantially minimize passage of water through said second band (4) and through said second venting openings (8), said second band (4) being connected to said central band portion (2) and also to said second side strip (23), and being disposed substantially adjacent said second venting openings (8).

The invention as described hereinabove in the context of the preferred embodiments is not to be taken as limited to all of the provided details thereof, since modifications and variations thereof may be made without departing from the spirit and scope of the invention.

What is claimed is:

1. A device for covering and ventilating a ridge or peak region of a roof, with a central cover band (2), a first side strip (24) provided with venting openings (11) to the right of the center of the cover band (2) and a second side strip (23) provided with venting openings (8) to the left of the center of the cover band (2), wherein between the central cover band (2) and the first side strip (24) is provided a first air-permeable, but water-impermeable, band (3), which covers over the venting openings (11) of the first side strip (24), and that between the central cover band (2) and the second side strip (23) is provided a second air-permeable, but water-impermeable, band (4), which covers over the venting openings (8) of the second side strip (23), wherein each of the air-permeable, but water-impermeable, bands (3,4) is connected with its one end to the cover band (2) and with its other end to a corresponding one of the side strips (23,24).

2. The device according to claim 1, wherein the side strips (23, 24) are connected with one another via a center strip (22) and form hereby a roof adjoining band (5), with the cover band (2) being disposed on the center strip (22) of the cover band (5).

3. The device according to claim 1, wherein the cover band (2) is water- and air-tight and covers over the venting openings (6 to 11).

4. The device according to claim 1, wherein the air-permeable, but water-impermeable, bands (3, 4) are developed in the manner of an accordion.

5. The device according to claim 1, wherein the air-permeable, but water-impermeable, bands (3, 4) are developed such that they are extensible.

6. The device according to claim 1, wherein the air-permeable, but water-impermeable, bands (3, 4) are spaced at a clearance from the venting openings (6 to 11).

7. The device according to claim 1, wherein one of (i), (ii), (iii) and (iv):

(i) the air-permeable, but water-impermeable, bands (3, 4) are comprised of nonwoven fabric;

(ii) the water- and air-tight cover band (2) is comprised of one of: synthetic material and metal;

(iii) each air-permeable, but water-impermeable, band (3, 4) is one of: adhered and welded, with one end to the cover band (2) and with its other end to the side strips (23, 24); and (iv) underneath the cover band (2) is provided an air-permeable, but water-impermeable, nonwoven fabric (44), whose side regions form the two bands (3, 4); and a region of the nonwoven fabric is disposed between the cover band (2) and a center strip (22).

8. The device according to claim 2, wherein:

the roof adjoining band (5) is comprised of crêped aluminum composite material;

the roof adjoining band (5) is fixable on roof tiles (31, 32) through adhesive strips (12, 13);

the adhesive strips (12, 13) are provided at the ends of the side strips (23, 24) of the roof adjoining band (5); and a region of the nonwoven fabric is disposed between the cover band (2) and a center strip (22).

9. A roof venting arrangement for covering and ventilating a peak region of a roof, said roof venting arrangement comprising:

a central cover band portion;

a first side strip and a second side strip, each being disposed on and connected to opposite sides of said central cover band portion;

each side strip comprising a plurality of venting openings to provide a venting path for air;

a first band and a second band, each comprising an air-permeable and substantially water-impermeable material and being connected between said central cover band portion and a corresponding one of said side strips; and each of said first band and said second band being disposed to cover said venting openings to minimize passage of water through said venting openings and to permit passage of air flowing through said venting openings, wherein each of the air-permeable, but water-impermeable, bands is connected with its one end to the cover band and with its other end to a corresponding one of the side strips.

10. The roof venting arrangement according to claim 9, wherein:

said vented side strips are connected to one another by a center strip; and said central cover band portion is connected to said connecting center strip.

11. The roof venting arrangement according to claim 10, wherein:

said central cover band portion has a length dimension and a width dimension, said length dimension being greater than said width dimension, said width dimension being sufficient to extend over said first and second venting openings.

12. The roof venting arrangement according to claim 11, wherein:

said venting bands comprise a material configured to vary in total length to permit movement between said venting bands and said central cover band portion.

13. The roof venting arrangement according to claim 12, wherein:

said material of said venting bands is folded in a zig-zag pattern having ridges and valleys, said ridges and valleys extending substantially parallel to said length dimension of said central cover band portion;

said venting bands are spaced at a predetermined distance away from their corresponding first and second venting openings;

one of (a.), (b.), and (c.):

(a.) said venting bands comprise a nonwoven fabric material;

(b.) said central cover band portion comprises a material of one of: a polymer material, and a metal; and (c.) said central cover band portion comprises a material configured to permit passage of air therethrough and configured to substantially minimize passage of water therethrough;

said venting bands each comprise a first connecting portion being connected to said central cover band portion and each also comprise a second connecting portion being connected to its corresponding first and second venting side strip;

said connection of said first and second connecting portions being by one of: adhering; and welding, to connect each first connecting portion to said central cover band portion and to connect each second connecting portion to its corresponding venting side strip;

said venting arrangement comprises at least a portion comprising crêped material, said crêped material comprising an aluminum composite material;

said venting arrangement comprises adhesive strips configured to secure said vented side strips to a roof;

said vented side strips each comprise an end portion;

said adhesive strips comprise first and second adhesive strips each disposed at their corresponding end portion of said vented side strips;

said venting bands comprise a nonwoven fabric material extending from opposite ends of said venting bands; and a portion of said nonwoven fabric material extending between said first and second venting bands is disposed between said central cover band portion and said connecting center strip.

14. The roof venting arrangement according to claim 9 comprising at least one of (A.), (B.), (C.), (D.), (E.), (F.), (G.), (H.), (I.), (J.), (K.), and (L.):

(A.) said vented side strips are connected to one another by a center strip; and said central cover band portion is connected to said connecting center strip;

(B.) said central cover band portion has a length dimension and a width dimension, said length dimension being greater than said width dimension, said width dimension being sufficient to extend over said first and second venting openings;

(C.) said venting bands comprise a material configured to vary in total length to permit movement between said venting bands and said central cover band portion;

(D.) said venting bands comprise a material configured to vary in total length to permit movement between said venting bands and said central cover band portion;

said material of said venting bands is folded in a zig-zag pattern having ridges and valleys, said ridges and valleys extending substantially parallel to said length dimension of said central cover band portion;

(E.) said venting bands are spaced at a predetermined distance away from their corresponding first and second venting openings;

(F.) one of (a.), (b.), and (c.):

(a.) said venting bands comprise a nonwoven fabric material;

(b.) said central cover band portion comprises a material of one of: a polymer material, and a metal; and (c.) said central cover band portion comprises a material configured to permit passage of air therethrough and configured to substantially minimize passage of water therethrough;

(G.) said venting bands each comprise a first connecting portion being connected to said central cover band portion and each also comprise a second connecting portion being connected to its corresponding first and second venting side strip;

said connection of said first and second connecting portions being by one of: adhering; and welding, to connect each first connecting portion to said central cover band portion and to connect each second connecting portion to its corresponding venting side strip;

(H.) said vented side strips are connected to one another by a center strip;

said central cover band portion is connected to said connecting center strip; and said venting arrangement comprises at least a portion comprising crêped material, said crêped material comprising an aluminum composite material;

(I.) said vented side strips are connected to one another by a center strip;

said central cover band portion is connected to said connecting center strip; and said venting arrangement comprises:

adhesive strips configured to secure said vented side strips to roofing tiles of a pitched tile roof;

(J.) said vented side strips each comprise an end portion, each end portion being configured and dimensioned to be disposed adjacent to roofing tiles upon installation of said pitched tile roof venting arrangement on a building roof; and a plurality of adhesive strips comprising first and second adhesive strips each disposed at corresponding end portion of said vented side strips;

(K.) said venting bands comprise a nonwoven fabric material extending from opposite ends of said venting bands; and (L.) said venting bands comprise a nonwoven fabric material extending from opposite ends of said venting bands;

said vented side strips are connected to one another by a center strip;

said central cover band portion is connected to said connecting center strip; and a portion of said nonwoven fabric material extending between said first and second venting bands is disposed between said central cove band portion and said connecting center strip.

15. A roof venting arrangement for covering and ventilating a peak region of a roof, said roof venting arrangement comprising:

a central cover band portion;

a first side strip and a second side strip, each being disposed on and connected to opposite sides of said central cover band portion;

each side strip comprising a plurality of venting openings to provide a venting path for air;

a first band and a second band, each comprising an air-permeable and substantially water-impermeable material and being connected between said central cover band portion and a corresponding one of said side strips; and each of said first band and said second band being disposed adjacent said venting openings to inhibit passage of water through said venting openings and to permit passage of air flowing through said venting openings, wherein each of the air-permeable, but water-impermeable, bands is connected with its one end to the cover band and with its other end to a corresponding one of the side strips.

16. The roof venting arrangement according to claim 15, wherein:

said vented side strips are connected to one another by a center strip; and said central cover band portion is connected to said connecting center strip.

17. The roof venting arrangement according to claim 16, wherein:

said central cover band portion has a length dimension and a width dimension, said length dimension being greater than said width dimension, said width dimension being sufficient to extend over said first and second venting openings.

18. The roof venting arrangement according to claim 17, wherein:

said venting bands comprise a material configured to vary in total length to permit movement between said venting bands and said central cover band portion.

19. The roof venting arrangement according to claim 18, wherein:

said material of said venting bands is folded in a zig-zag pattern having ridges and valleys, said ridges and valleys extending substantially parallel to said length dimension of said central cover band portion;

said venting bands are spaced at a predetermined distance away from their corresponding first and second venting openings;

one of (a.), (b.), and (c.):

(a.) said venting bands comprise a nonwoven fabric material;

(b.) said central cover band portion comprises a material of one of: a polymer material, and a metal; and (c.) said central cover band portion comprises a material configured to permit passage of air therethrough and configured to substantially minimize passage of water therethrough;

said venting bands each comprise a first connecting portion being connected to said central cover band portion and each also comprise a second connecting portion being connected to its corresponding first and second venting side strip;

said connection of said first and second connecting portions being by one of: adhering; and welding, to connect each first connecting portion to said central cover band portion and to connect each second connecting portion to its corresponding venting side strip;

said venting arrangement comprises at least a portion comprising crêped material, said crêped material comprising an aluminum composite material;

said venting arrangement comprises adhesive strips configured to secure said vented side strips to a roof;

said vented side strips each comprise an end portion;

said adhesive strips comprise first and second adhesive strips each disposed at their corresponding end portion of said vented side strips;

said venting bands comprise a nonwoven fabric material extending from opposite ends of said venting bands; and a portion of said nonwoven fabric material extending between said first and second venting bands is disposed between said central cover band portion and said connecting center strip.

20. The roof venting arrangement according to claim 15 comprising at least one of (A.), (B.), (C.), (D.), (E.), (F.), (G.), (H.), (I.), (J.), (K.), and (L.):

(A.) said vented side strips are connected to one another by a center strip; and said central cover band portion is connected to said connecting center strip;

(B.) said central cover band portion has a length dimension and a width dimension, said length dimension being greater than said width dimension, said width dimension being sufficient to extend over said first and second venting openings;

(C.) said venting bands comprise a material configured to vary in total length to permit movement between said venting bands and said central cover band portion;

(D.) said venting bands comprise a material configured to vary in total length to permit movement between said venting bands and said central cover band portion;

said material of said venting bands is folded in a zig-zag pattern having ridges and valleys, said ridges and valleys extending substantially parallel to said length dimension of said central cover band portion;

(E.) said venting bands are spaced at a predetermined distance away from their corresponding first and second venting openings;

(F.) one of (a.), (b.), and (c.):

(a.) said venting bands comprise a nonwoven fabric material;

(b.) said central cover band portion comprises a material of one of: a polymer material, and a metal; and (c.) said central cover band portion comprises a material configured to permit passage of air therethrough and configured to substantially minimize passage of water therethrough;

(G.) said venting bands each comprise a first connecting portion being connected to said central cover band portion and each also comprise a second connecting portion being connected to its corresponding first and second venting side strip;

said connection of said first and second connecting portions being by one of: adhering; and welding, to connect each first connecting portion to said central cover band portion and to connect each second connecting portion to its corresponding venting side strip;

(H.) said vented side strips are connected to one another by a center strip;

said central cover band portion is connected to said connecting center strip; and said venting arrangement comprises at least a portion comprising crêped material, said crêped material comprising an aluminum composite material;

(I.) said vented side strips are connected to one another by a center strip;

said central cover band portion is connected to said connecting center strip; and said venting arrangement comprises:

adhesive strips configured to secure said vented side strips to roofing tiles of a pitched tile roof;

(J.) said vented side strips each comprise an end portion, each end portion being configured and dimensioned to be disposed adjacent to roofing tiles upon installation of said pitched tile roof venting arrangement on a building roof; and a plurality of adhesive strips comprising first and second adhesive strips each disposed at corresponding end portion of said vented side strips;

(K.) said venting bands comprise a nonwoven fabric material extending from opposite ends of said venting bands; and (L.) said venting bands comprise a nonwoven fabric material extending from opposite ends of said venting bands;

said vented side strips are connected to one another by a center strip;

said central cover band portion is connected to said connecting center strip; and a portion of said nonwoven fabric material extending between said first and second venting bands is disposed between said central cover band portion and said connecting center strip.

* * * * *